US008393082B2

(12) United States Patent
Shimizu

(10) Patent No.: US 8,393,082 B2
(45) Date of Patent: Mar. 12, 2013

(54) ROTARY ELECTRIC SHAVER

(75) Inventor: Tetsuhiko Shimizu, Matsumoto (JP)

(73) Assignee: Izumi Products Company, Nagano (JP)

( * ) Notice: Subject to any disclaimer, the term of this patent is extended or adjusted under 35 U.S.C. 154(b) by 364 days.

(21) Appl. No.: 12/806,100

(22) Filed: Aug. 5, 2010

(65) Prior Publication Data

US 2011/0030220 A1 Feb. 10, 2011

(30) Foreign Application Priority Data

Aug. 6, 2009 (JP) ..... 2009-183104

(51) Int. Cl.
*B26B 19/16* (2006.01)
*B26B 19/14* (2006.01)
*B26B 19/38* (2006.01)

(52) U.S. Cl. ..... 30/43.6; 30/43.5; 30/527

(58) Field of Classification Search ..... 30/43.4, 30/43.5, 43.6, 527, 529, 530
See application file for complete search history.

(56) References Cited

U.S. PATENT DOCUMENTS

| | | | | |
|---|---|---|---|---|
| 5,007,168 | A * | 4/1991 | Messinger et al. | 30/43 |
| 5,577,324 | A * | 11/1996 | Tanaka | 30/43.6 |
| 6,581,289 | B2 * | 6/2003 | Nakano | 30/43.6 |
| 6,722,038 | B2 * | 4/2004 | Visman et al. | 30/43.6 |
| 7,370,420 | B2 * | 5/2008 | Shimizu | 30/43.4 |
| 7,743,508 | B2 * | 6/2010 | Shimizu | 30/43.6 |
| 7,845,078 | B2 * | 12/2010 | Shimizu | 30/43.5 |
| 8,220,157 | B2 * | 7/2012 | Shimizu | 30/43.4 |
| 2007/0124936 | A1 * | 6/2007 | Okabe | 30/43.6 |
| 2007/0277379 | A1 * | 12/2007 | Okabe | 30/43.92 |
| 2008/0034591 | A1 * | 2/2008 | Fung | 30/43.92 |
| 2008/0092393 | A1 * | 4/2008 | Van Der Meer | 30/43.6 |
| 2010/0287784 | A1 * | 11/2010 | Qiu | 30/527 |
| 2011/0173815 | A1 * | 7/2011 | Koike | 30/43.6 |
| 2011/0308088 | A1 * | 12/2011 | Brada et al. | 30/43.6 |

FOREIGN PATENT DOCUMENTS

| | | | |
|---|---|---|---|
| CN | 201 128 163 | Y | 10/2008 |
| CN | 201 198 144 | Y | 2/2009 |
| EP | 0 176 128 | A | 4/1986 |
| EP | 0 375 949 | A | 7/1990 |
| EP | 0 543 460 | A | 5/1993 |
| EP | 0 721 826 | A | 7/1996 |
| JP | H9-503424 | | 4/1997 |
| JP | 2006-158519 | | 6/2006 |
| JP | 2011-98041 | * | 5/2011 |
| WO | WO 2010/034175 | A | 4/2010 |

* cited by examiner

*Primary Examiner* — Hwei C Payer
(74) *Attorney, Agent, or Firm* — DLA Piper LLP (US)

(57) ABSTRACT

A rotary electric shaver including cutter units, each having an outer cutter and an inner cutter rotating in resilient contact with the inner surface of the outer cutter, further including a shaver head which is pivotably provided on the shaver main body; an outer cutter frame attached to the shaver head to support the outer cutters in a depressible fashion; a main drive shaft for transmitting, via a first universal joint, the rotation of a motor housed in the shaver main body to a driving mechanism provided inside the shaver head; inner cutter drive shafts provided in the shaver head and rotationally driven by the driving mechanism; and second universal joints for transmitting the rotation of the inner cutter drive shafts to the inner cutters; and in this shaver the first universal joint being disposed near the pivotal center of the shaver head.

5 Claims, 7 Drawing Sheets

ROTARY ELECTRIC SHAVER

BACKGROUND OF THE INVENTION

1. Field of the Invention

The present invention relates to a rotary electric shaver in which a plurality of cutter units including inner cutters rotating in sliding contact with the lower faces of outer cutters are provided on a shaver main body that houses a motor, etc.

2. Description of the Related Art

In one type of electric shaver, a plurality of outer cutters are provided in an outer cutter frame, which is securely attached to a shaver main body, so that the outer cutters are respectively allowed to make fine vertical (depressible) or pivotal motion (hereinafter simply and collectively called "vertical motion" as well) independently. In such shavers, the range of mobility of the outer cutters is generally small, and thus the shaving surfaces of the outer cutters cannot be brought close enough to the skin and is limited in possible improvements in shaving feeling.

The inventor of the present application has previously proposed an idea in which outer cutters are provided in respective substantially cage-like pivoting cases so as to make fine vertical motion and, on the other hand, these pivoting cases are disposed respectively in an outer cutter frame (that is securely attached to the shaver main body) so as to make independent pivotal motion (see FIG. 4, etc. of the Japanese Patent Application No. 2004-351628 (Laid-Open No. 2006-158519)).

In the electric shaver disclosed in the Japanese Patent Application National Publication (Kohyo) No. H9-503424, the outer cutters are respectively provided in a skin-supporting rim that is split into sections for each respective outer cutter, and adjacent skin-supporting rims are joined together with hinges or pivotally supported in a skin-supporting rim holder (which corresponds to the outer cutter frame securely attached to the shaver main body of the shaver of the invention of the present application).

In the shavers disclosed in the above-identified Japanese publications, the drive shafts (inner cutter drive shafts) that respectively correspond to the outer cutters are protruded from the shaver main body, and the upper ends of these drive shafts are engaged with the inner cutters through universal joints to rotate the inner cutters.

As seen from the above, in any of these conventional shavers, drive shafts corresponding to outer cutters are protruded from the shaver main body, and the upper ends of these drive shafts are engaged with the inner cutters of the cutter units through universal joints.

In such shavers, if the amount of pivotal motion of the outer cutters is small, then the range of flexion and extension/contraction of the universal joint is also small and, therefore, the load applied to the universal joint does not become excessively large. However, when the pivoting cases that hold the outer cutters (in Japanese Patent Application No. 2004-351628 (Laid-Open No. 2006-158519)) and the skin-supporting rims (in Japanese Patent Application National Publication (Kohyo) No. H9-503424) are rendered moveable separately from the outer cutters, the range of flexion and extension/contraction of the universal joints of the drive shafts increase. This leads to a decrease in the durability of the universal joints and contributes to the production of abnormal sounds and noise.

BRIEF SUMMARY OF THE INVENTION

The present invention is created with the above-described considerations in mind, and it is an object of the present invention to provide a rotary electric shaver that reduces the amount of the flexion and the amount of extension/contraction of the universal joints that link the drive shafts to the inner cutters, so that the durability of the universal joints is improved and the production of abnormal sounds and noise is reduced.

The above-described object is accomplished by a unique structure of the present invention for a rotary electric shaver that includes a plurality of cutter units, each comprising a substantially disk-shaped outer cutter and an inner cutter rotating in resilient contact with the inner surface of the outer cutter; and in the present invention, the rotary electric shaver further includes:

- a shaver head which is pivotably provided on the shaver main body;
- an outer cutter frame that is attached to the shaver head and supports the outer cutters in a vertically movable (or depressible) fashion;
- a main drive shaft that transmits, via a first universal joint, a rotational output of a motor provided inside the shaver main body to a driving mechanism provided inside the shaver head;
- a plurality of inner cutter drive shafts provided in the shaver head and rotationally driven by the driving mechanism; and
- a plurality of second universal joints that transmit the rotation of the inner cutter drive shafts to the inner cutters of the corresponding cutter units; and
- in this shaver, the first universal joint is provided in a vicinity of a pivotal center of the shaver head.

As seen from the above, in the present invention, the tilting of the outer cutters is divided into the pivotal motion of the shaver head relative to the shaver main body and the pivotal motion of the outer cutters relative to the shaver head (and, therefore, the outer cutter frame). Accordingly, the tilting of the outer cutters is absorbed by the respective flexion and extension/contraction of the first universal joint of the main drive shaft and by the second universal joints of the inner cutter drive shafts. The respective ranges of the flexion and extension/contraction of the first and second universal joints thus become smaller, and the loads applied to these universal joints can be reduced. As a result, the durability of the universal joints increases, and the production of abnormal sounds and noise is prevented. Furthermore, the shaving feel is improved because the outer cutters have increased range of mobility.

In the present invention, the junction between the shaver head and the shaver main body is formed by a hemispherical sliding surface which is provided in one of these two elements (for example, the shaver head) and a sliding surface support portion which is provided in the other of such two elements (for example, the shaver main body). Accordingly, the shaver head can pivot in an orderly fashion (in other words, pivot (swivel) by being defined by the spherical surface of the hemispherical sliding surface) with respect to the shaver main body. In this structure, it is preferable that the first universal joint be provided in the vicinity of the pivotal center of this junction between the shaver head and the shaver main body (in other words, provided at the center of curvature of the hemispherical sliding surface).

This junction between the shaver head and the shaver main body can be surrounded by a bellows-like boot which is adapted to resiliently pull the shaver head and the shaver main body toward each other. As a result, the number of parts can be reduced, and the construction is simplified.

In the present invention, the first universal joint has such a construction, for instance, that a coupling-element is provided on one of the input/output shafts (the main drive shaft and the driven shaft on the driving mechanism side), and an coupled-element is provided on the other shaft, and mutual engagement of these elements is obtained by engaging radial pawls provided in one of these two elements with elongated grooves extending in the axial direction and provided in the other one of these two elements. In this structure, the rotational power of the motor is transmitted via the engagement between the pawls and the elongated grooves, and displacement in the direction of extension/contraction of the bellows-like boot is absorbed when the pawls move in the axial direction inside the elongated grooves.

The driving mechanism provided inside the shaver head can be comprised of a driving spur gear, which is formed integrally (including integrally molded or obtained by joining separate pieces) with the coupled-element on the output shaft side of the first universal joint, and a plurality of driven spur gears, which are securely attached to the inner cutter drive shafts of the cutter units and meshing with the driving spur gear. In this structure, the output shaft of the first universal joint can be formed integrally with the driving spur gear so as to reduce the thickness of the driving mechanism and as a result make it easier to accommodate it inside the shaver head, and the location of the driving spur gear is provided closer to the pivotal center of the shaver head so as to reduce the dimensions of the shaver head. In particular, by way of recessing the center of the lower face of the driving spur gear and allowing the pivotal center of the shaver head to enter in this recess, the dimensions of the shaver head can be further reduced.

DETAILED DESCRIPTION OF THE INVENTION

Figure 1:
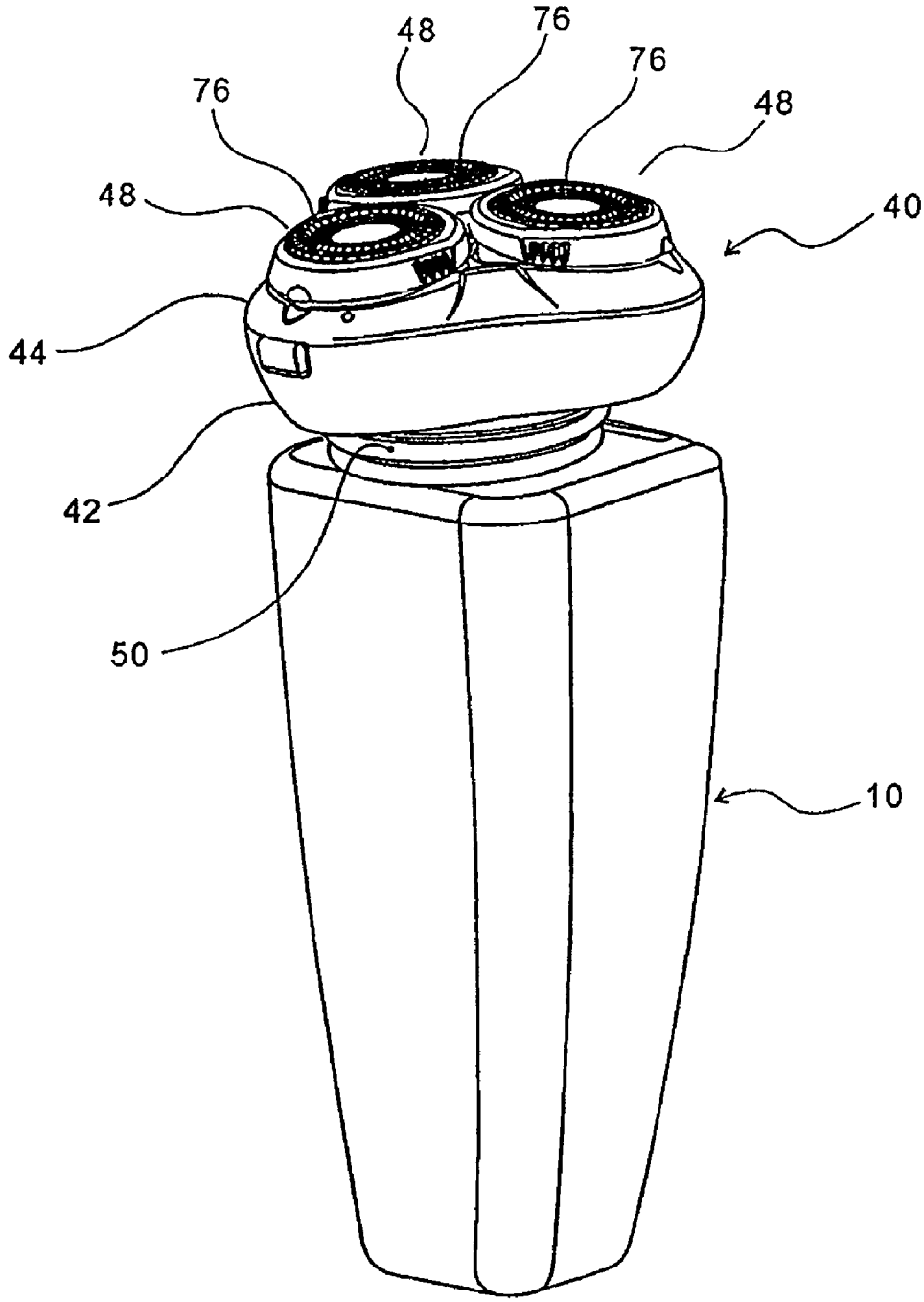
FIG. 1 is a perspective view illustrating one embodiment of the electric shaver according to the present invention.

In FIGS. 1 to 4, the reference numeral 10 designates a shaver main body having a longitudinally elongated prismatic housing 12. Although this housing 12 is in fact formed by assembling members split apart by appropriate dividing surfaces (not shown), for the convenience of description, in FIGS. 2 and 3 the entire body is drawn as a unitary body.

Figure 3:
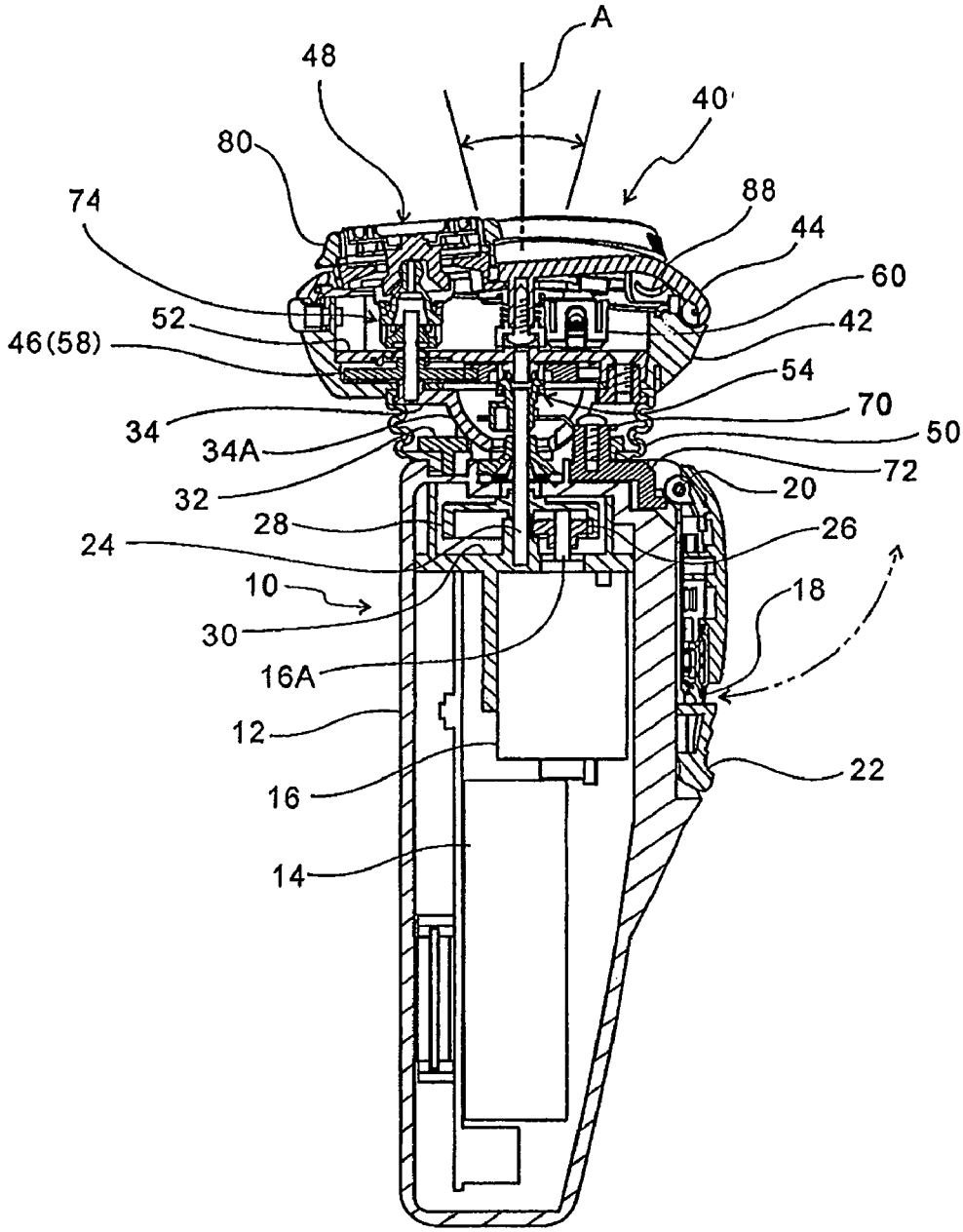
FIG. 3 is a vertical cross-sectional right-side view of the shaver.

Inside the housing 12, a rechargeable battery 14 is accommodated in the bottom portion, and an electric motor 16 is accommodated above the battery 14. As best seen in FIG. 3, a trimmer (trimming blade) 18 is mounted on the rear face of the housing 12 such that it can be opened by flipping it over backwards as shown by dotted line arrow around a pivot point 20. The reference numeral 22 designates an actuator used to raise and store the trimmer 18.

As shown in FIG. 3, the motor 16 is installed inside the housing 12 so that it is on the rear side of the housing. The rotary output shaft 16A of the motor 16 is oriented vertically (or along a centerline A). A main drive shaft 24 is provided in front of this output shaft 16A (so as to be on the front side of the housing 12). The main drive shaft 24 is parallel to the output shaft 16A of the motor 16, and its top portion protrudes upwardly from the shaver main body 10. The rotation of the output shaft 16A of the motor 16 is transmitted to the main drive shaft 24 via a speed reducer which is made up of, as seen from FIG. 2, a pinion gear 26 and an internally toothed gear wheel 28. The lower end of the main drive shaft 24 is rotationally supported on a partition plate 30 (see FIG. 3) that is securely provided inside the housing 12, and its middle portion passes through and is rotationally supported by a sliding plate seat 32 that is fixed to the upper end face of the housing 12.

Figure 2:
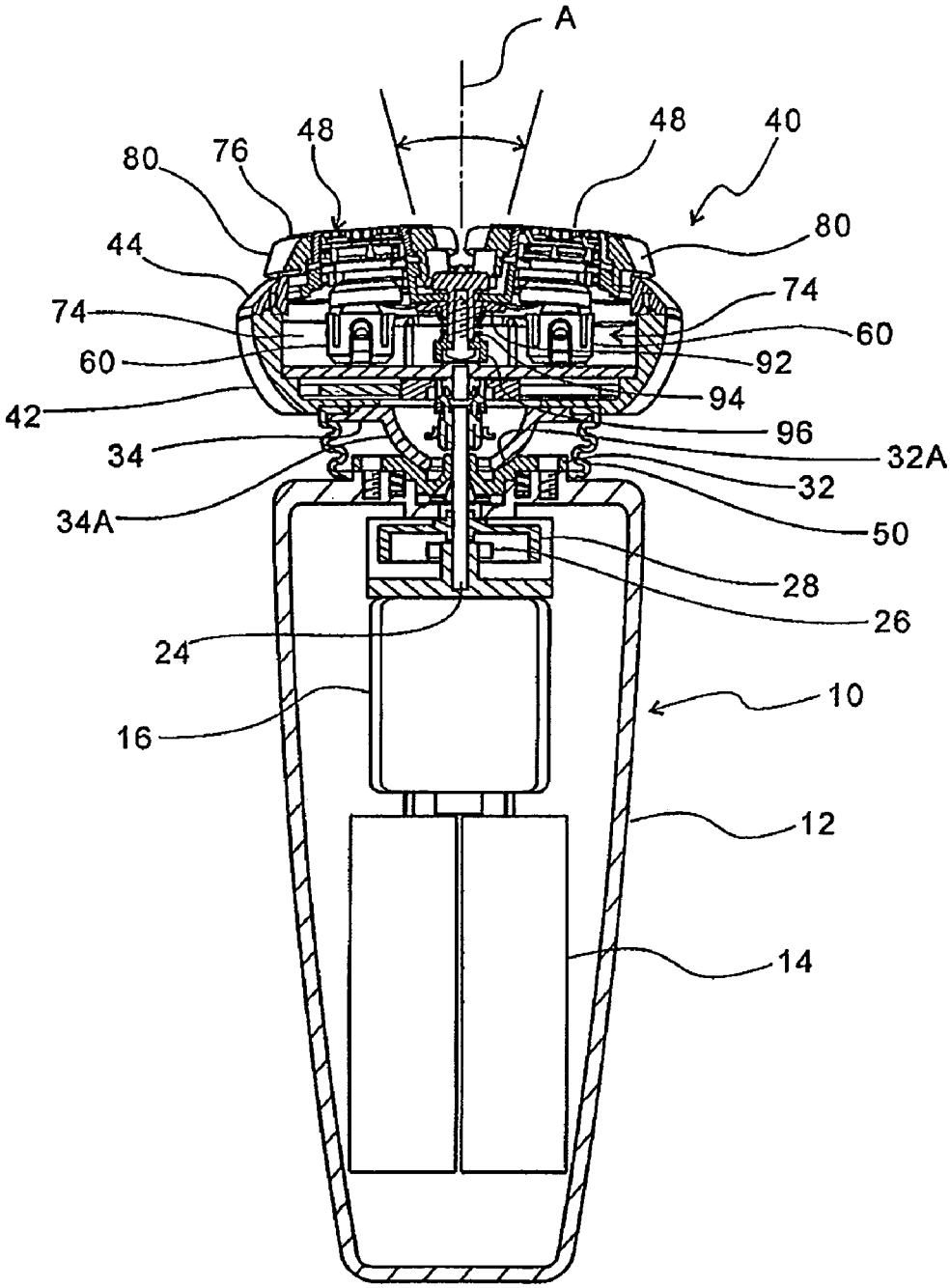
FIG. 2 is a vertical cross-sectional front view of the shaver.

As shown in FIG. 2, the sliding plate seat 32 makes sliding contact with the downwardly convex spherical sliding surface 34A of a sliding plate 34 from below. In other words, the upper face of the sliding plate seat 32 constitutes a sliding surface support portion 32A that supports the hemispherical sliding surface 34A of the sliding plate 34. As a result, the sliding plate 34, together in a integral fashion with a shaver head 40 which will be described below, can be pivoted with respect to the shaver main body 10 in an orderly fashion by the mated sliding surface 34A and sliding surface support portion 32A.

The shaver head 40, which is integral with the sliding plate 34, is pivotable back and forth as shown by a curved arrow in FIG. 3 and side to side as shown by a curved arrow in FIG. 2 around the centerline A that passes through the main drive shaft 24, thus being swivel. The shaver head 40 comprises a head case 42, which is joined to the upper face of the sliding plate 34, an outer cutter frame 44, which is fitted over this head case 42 from above, a driving mechanism 46, which is provided inside the inner bottom portion of the head case 42, and three cutter units 48, which are provided in the outer cutter frame 44 so as to make fine vertical (depressible) and pivotal motions. When viewed from above (the shaver head 40), the three cutter units 48 are disposed at equal distances apart, circumferentially, around the centerline A passing through the main drive shaft 24.

The sliding plate 34 and the sliding plate seat 32, which constitute a junction between the shaver head 40 and the shaver main body 10, are, as seen from FIGS. 2 and 3, surrounded by a bellows-like boot 50. This boot 50 possesses an appropriate recoil force at least in the direction of contraction (which is along the centerline A). The edge of the lower end opening of the boot 50 is sandwiched between the upper face of the housing 12 and the lower face of the sliding plate seat 32, and the edge of the upper end opening of the boot 50 is sandwiched between the upper face of the sliding plate 34 and the lower face of the head case 42. As a result, appropriate contact pressure is maintained between the sliding plate 34 and the sliding plate seat 32, which provides smooth sliding in between; and on the other hand, the shaver head 40 is prevented from separating from the shaver main body 10.

The driving mechanism 46 is, as shown in FIG. 3, provided between the bottom face of the head case 42 and a support plate 52 which is held with some space above the bottom of the head case 42. More specifically, as seen from FIG. 4, the driving mechanism 46 comprises a driving spur gear 56, which is connected to the upper end of the main drive shaft 24 via a first universal joint 54 (see FIGS. 3 and 5 to 7), and three driven spur gears 58, which are arranged in a circumferentially equally spaced relationship to surround the driving spur gear 56 and are in meshing engagement with the driving spur gear 56. The lower ends of the shafts of the three driven spur gears 58 are rotationally supported by the sliding plate 34 while the top portions pass through the partition plate 52 via hair-blocking gaskets 58A (FIG. 4) and are joined to the inner cutter drive shafts 60 of the cutter units 48.

Figure 4:
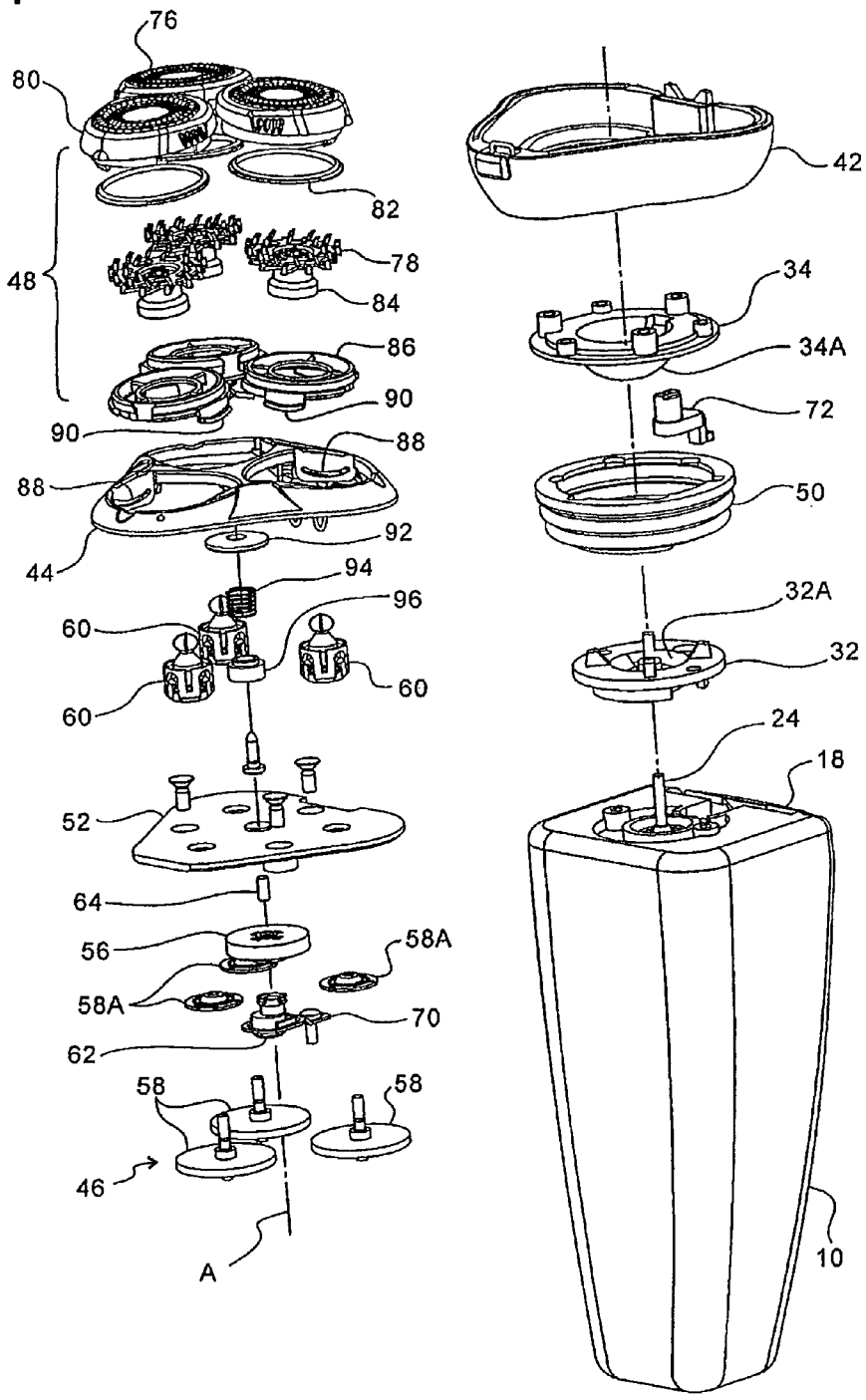
FIG. 4 is an exploded perspective view of the shaver head of the shaver.
Figure 7A:
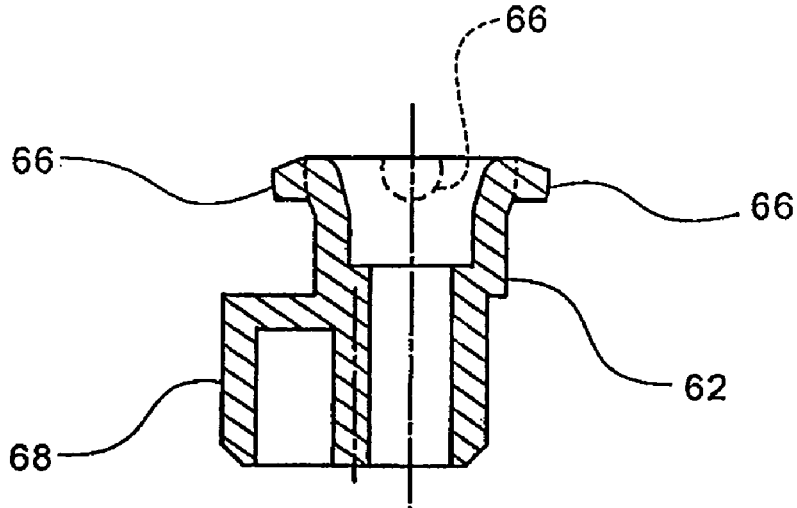
FIG. 7A is a vertical cross-sectional side view of the coupling shaft serving as a coupling-element of the first universal joint.
Figure 7B:
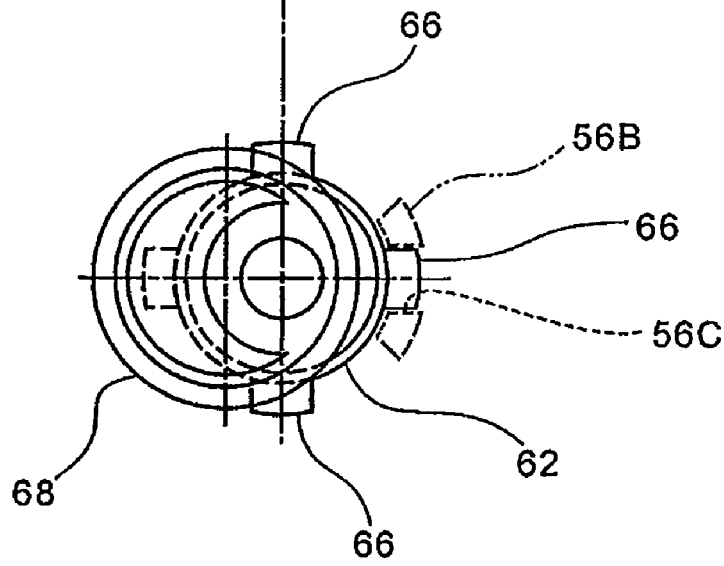
FIG. 7B is a bottom view thereof.

As seen from FIG. 4, the first universal joint 54 (see FIG. 5) comprises a coupling shaft 62, which is securely attached to the main drive shaft 24, and a spindle 64, which passes through the center of the driving spur gear 56 and is supported by the partition plate 52. The spindle 64 is securely attached to the partition plate 52; and on the other hand, the driving spur gear 56 is rotatably supported by the spindle 64 from below and is pushed upward by a coil spring 65 (see FIG. 5) that is compression-loaded between the super gear 56 and the coupling shaft 62 so that it is prevented from detaching. As shown in FIGS. 7A and 7B, the coupling shaft 62 is formed with four pawls 66 which protrude outwards in the radial direction.

Figure 5:
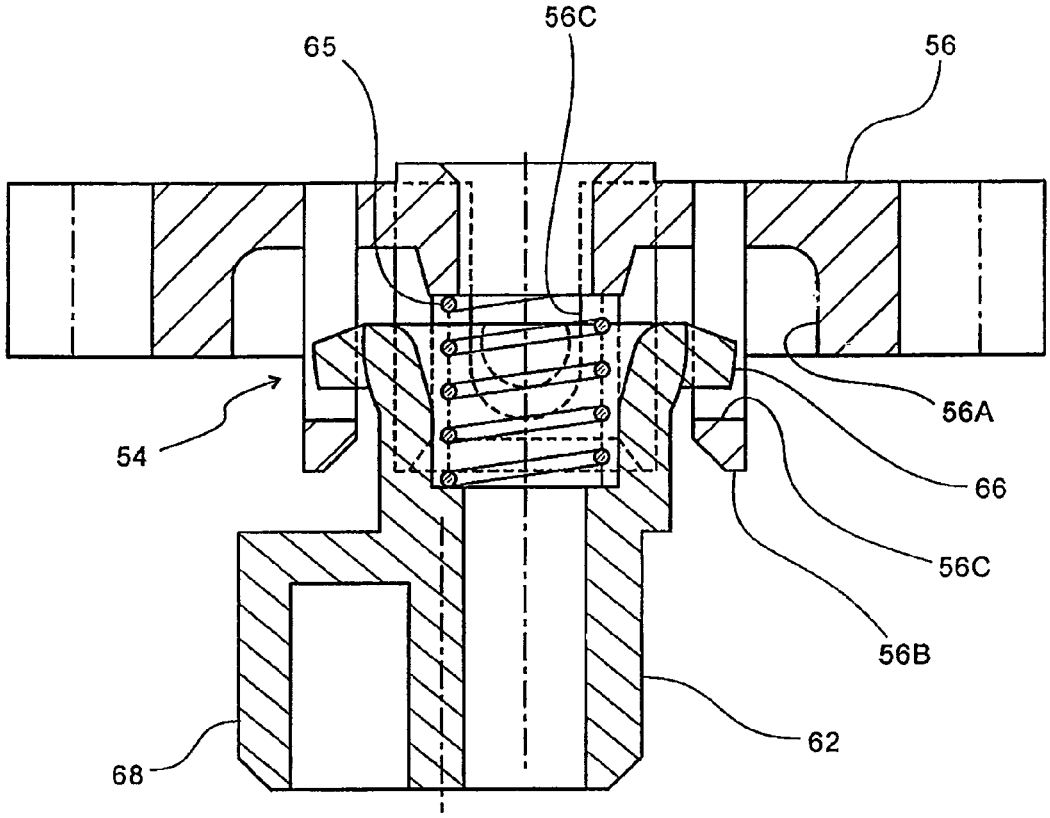
FIG. 5 is a cross-sectional right-side view of the first universal joint used in the shaver.
Figure 6A:
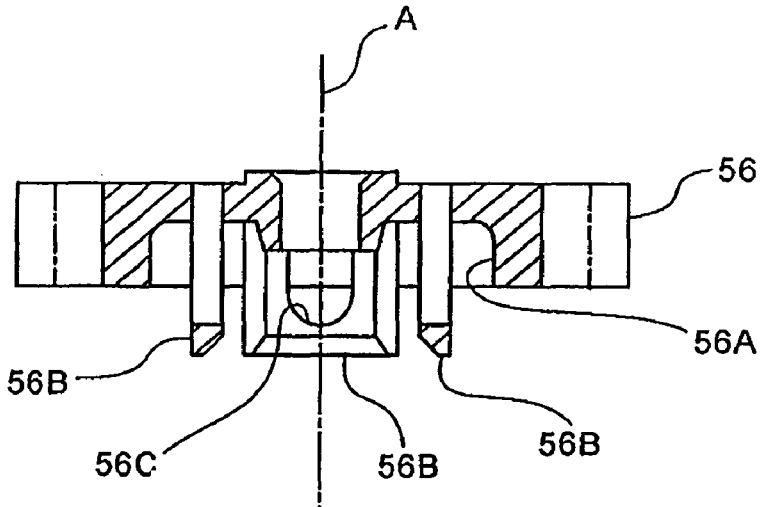
FIG. 6A is a vertical cross-sectional side view of the driving gear serving as an coupled-element of the first universal joint.
Figure 6B:
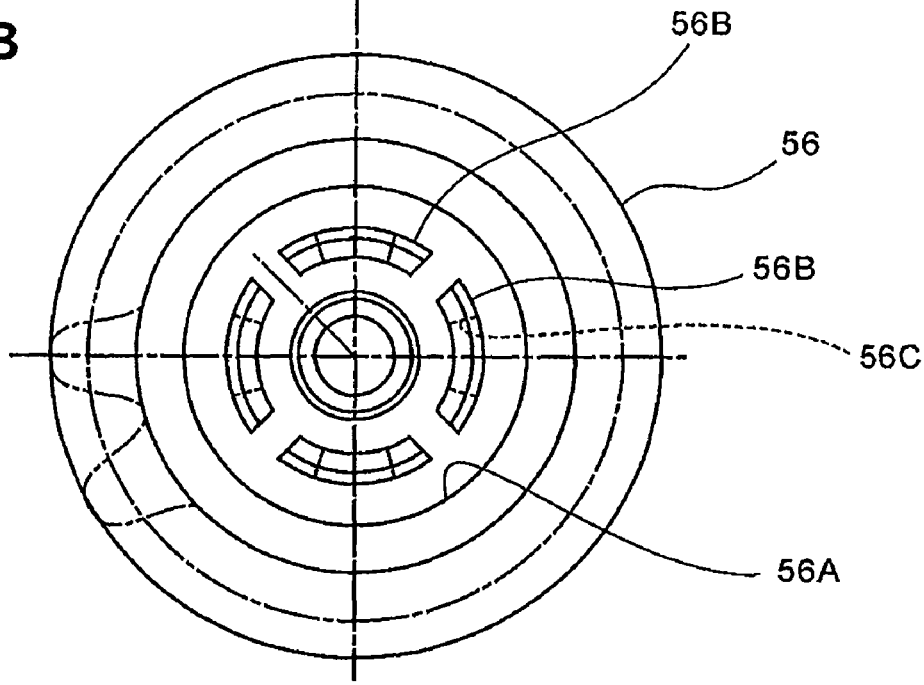
FIG. 6B is a bottom view thereof.

As shown in FIG. 5, the driving spur gear 56 is formed with a recess 56A in the central portion of its lower face, and it also has, as best seen from FIGS. 6A and 6B, four U-shaped members 56B that are formed to suspend in the recess 56A. Each of the U-shaped members 56B is formed with vertically (or parallel to the centerline A) elongated groove 56C. These U-shaped members 56B are arranged so as to surround the coupling shaft 62 (see FIG. 5). When the driving spur gear 56 and the coupling shaft 62 are combined, the four pawls 66 engage the elongated grooves 56C of the U-shaped members 56B. As a result, the first universal joint 54 is brought closer to the driving spur gear 56. The center of curvature (the center of the hemispherical surface) of the sliding surface 34A of the sliding plate 34, which constitutes the junction between the shaver head 40 and the shaver main body 10, is disposed above or in the vicinity of the first universal joint 54; and as a result, the shaver head 40 can be smoothly pivoted (swivel) around the first universal joint 54.

Furthermore, as seen from FIGS. 7A and 7B, the coupling shaft 62 is formed with a cam 68, which is an eccentric cylinder, so as to be molded integrally with its lower portion. This cam 68 drives the trimmer 18. In other words, a cam follower 70 (see FIGS. 3 and 4), which is engaged with the cam 68 and pivots, is securely attached to the fulcrum portion of a trimmer-driving lever 72 supported by the sliding plate seat 32, thus pivoting the trimmer-driving lever 72. When the trimmer 18 is raised, the trimmer-driving lever 72 engages the trimmer 18 and causes the trimmer 18 to reciprocate.

As described above, the shafts of the three driven spur gears 58 of the driving mechanism 46 protrude through the partition plate 52, and the inner cutter drive shafts 60 are coupled to the protruding portions of the shafts of the driven spur gears 58. The inner cutter drive shafts 60, whose construction is a similar to that of the first universal joint 54, are imparted with return-seeking behavior by compression-loading coil springs provided inside. This return-seeking behavior of the inner cutter drive shafts 60 provide contact pressure that is applied to the outer cutters 76 by the inner cutters 78 that will be described below.

The inner cutter drive shafts 60 are engaged with the inner cutters via second universal joints 74. More specifically, the upper end of each one of the inner cutter drive shafts 60 is spherical and substantially rectangular when viewed in plane or from above and has four outwardly curved ridges along two diagonal lines when viewed from above, thus forming a spherical engaging portion. The four ridges are brought from below to enter the four corners of a downwardly opened substantially rectangular concave portion formed inside the supporting boss portion of the corresponding inner cutter 78, so that the spherical engaging portion of the cutter shaft 60 is pivotally engaged with the supporting boss portion of the inner cutter 78. The second universal joints 74 that allow the inner cutters 78 to pivot (to make a seesaw motion) in the direction of two diameters crossing at right angles are thus formed. It should be noted that since the inner cutter drive shafts 60 in the shown embodiment possess universal joint functionality, the second universal joints can be formed by the universal joint action of these inner cutter drive shafts 60 and the universal joints composed of the spherical portions at the distal ends of the inner cutter drive shafts 60 and the concave portions on the inner cutter side, with which they are engaged.

Each of the cutter units 48 is comprised of a substantially disk-shaped outer cutter 76 and an inner cutter 78 that rotates in sliding contact with the inner surface of the (corresponding) outer cutter 76. The outer cutter 76 has a plurality of radial slits formed in it upper face such that hairs that enter these slits are cut off by the (rotating) inner cutter 78. The peripheral edge of the outer cutter 76 is bent downward, and an outer cutter ring 80 is fitted to its peripheral edge. As seen from FIG. 4, a stopper ring 82 is fitted to the internal circumference of this outer cutter ring 80 so as to secure the outer cutter 76 to the outer cutter ring 80.

Each of the inner cutters 78 is securely attached to an inner cutter support stand 84 which is formed in its boss portion with a concave portion, with which the upper end (spherical portion) of each of the inner cutter drive shafts 60 is engaged. The inner cutters 78 are supported on inner cutter seats 86, which are fitted to the outer cutter rings 80, so as to enable free motion alongside the outer cutters 76, thereby forming three independent cutter units 48.

These three cutter units 48 are inserted from below into three openings formed in the outer cutter frame 44. When inserted, the inner cutter seats 86 of the cutter units 48 are perpendicular to the centerline A and to straight lines passing through the centers of the outer cutters 76 and can be pivoted around pivotal axes passing through the centers of the outer cutters 76. In FIGS. 3 and 4, each of the arcuate tongues 90, which are formed in the inner cutter seats 86, is engaged with each of the arcuate slots 88 formed in the outer cutter frame 44, so that the inner cutter seats 86 can move in a seesaw fashion (pivot) while being restricted by the arcuate slots 88 of the outer cutter frame 44.

As shown in FIGS. 2 and 3, the centerline A side of each of the three inner cutter seats 86 extends in the direction toward the boss portion provided in the central portion of the lower face of the outer cutter frame 44, and these extended portions are resiliently pushed upwards by a dish-shaped disk 92 loaded from below in the boss portion. In other words, a coil spring 94 is provided on the boss portion, and the lower end of the coil spring 94 is supported by a washer member 96 securely attached to the boss portion from below, and the upper end of the coil spring 94 is in contact with the under face of the disk 92 (see FIGS. 4, 2, and 3).

As a result, the inner cutter seats 86 effect pivotal, i.e. seesaw, motion such that the center side of the outer cutter frame 44 is pushed downward, while the center side is moved vertically and returns in an upward direction by the spring force of the coil spring 94 (as illustrated in FIGS. 2 and 3). Furthermore, due to the sliding motion of the sliding surface 34A of the sliding plate 34 and the sliding surface support portion 32A of the sliding plate seat 32, the shaver head 40 pivots around centerline A in all directions or it swivels. Urged by the resilience of the bellows-like boot 50 that surrounds this junction between the sliding surface 34A of the sliding plate 34 and the sliding surface support portion 32A of the sliding plate seat 32, the center of the shaver head 40 returns to the original position that is on the . centerline A, and the shaver head 40 takes the upright posture as shown in FIGS. 2 and 3. Accordingly, as a result of the pivotal (seesaw) motion of the cutter units 48 and the omnidirectional pivotal motion (or swivel motion) of the shaver head 40 around the centerline A, the outer cutters 76 is able to maintain intimate contact with the skin while following the curved surface of the skin at appropriate tilting angles during shaving. As a result, the shaver provides for an delightful shaving feeling.

The invention claimed is:

1. A rotary electric shaver comprising:

a shaver main body;

a plurality of cutter units, each including a substantially disk-shaped outer cutter and an inner cutter rotating in resilient contact with the inner surface of the outer cutter;

a shaver head pivotably provided on the shaver main body;

an outer cutter frame included in said shaver head and supporting the outer cutters in a vertically movable fashion;

a main drive shaft for transmitting, via a first universal joint, a rotational output of a motor provided inside the shaver main body to a driving mechanism provided inside the shaver head;

a plurality of inner cutter drive shafts provided in the shaver head and rotationally driven by the driving mechanism; and a plurality of second universal joints for transmitting a rotation of the inner cutter drive shafts to the inner cutters of corresponding cutter units; wherein the first universal joint is provided in a vicinity of a pivotal center of the shaver head, said first universal joint comprises a coupling-element, which is securely attached to said main drive shaft that is provided on a shaver main body side, and a coupled-element, which is securely attached to a driven shaft that is provided on a driving mechanism side, and radial pawls, provided in one of the coupling-element and the coupled-element, and axial elongated grooves, provided in the other one of the coupling-element and the coupled-element, are brought into mutual engagement.

2. The rotary electric shaver according to claim 1, wherein a junction between the shaver head and the shaver main body is formed with a downwardly convex hemispherical sliding surface and a sliding surface support portion, one of said sliding surface and said support portion being provided on one of said shaver head and said shaver main body, and the other one of said sliding surface and said support portion being provided on the other one of said shaver head and said shaver main body; and said first universal joint is disposed near a center of curvature of said hemispherical sliding surface.

3. The rotary electric shaver according to claim 1, wherein a junction between the shaver head and the shaver main body is surrounded by a bellows-like boot, and said bellows-like boot resiliently pulls said shaver head and said shaver main body together toward each other.

4. A rotary electric shaver comprising:

a shaver main body;

a plurality of cutter units, each including a substantially disk-shaped outer cutter and an inner cutter rotating in resilient contact with the inner surface of the outer cutter;

a shaver head pivotably provided on the shaver main body;

an outer cutter frame included in said shaver head and supporting the outer cutters in a vertically movable fashion;

a main drive shaft for transmitting, via a first universal joint, a rotational output of a motor provided inside the shaver main body to a driving mechanism provided inside the shaver head;

a plurality of inner cutter drive shafts provided in the shaver head and rotationally driven by the driving mechanism; and a plurality of second universal joints for transmitting a rotation of the inner cutter drive shafts to the inner cutters of corresponding cutter units, wherein the first universal joint is provided in a vicinity of a pivotal center of the shaver head, and said driving mechanism housed in said shaver head comprises:

a driving spur gear which is integral with a coupled-element of said first universal joint, and a plurality of driven spur gears each securely attached to said inner cutter drive shaft of each one of said cutter units and meshed with said driving spur gear.

5. The rotary electric shaver according to claim 4, wherein a driven shaft of said first universal joint is integral with said driving spur gear, and a center of a lower face of said driving spur gear is recessed, and the pivotal center of said shaver head is disposed within said recess.

* * * * *